US005625743A

United States Patent [19]

Fiocca

[11] Patent Number: 5,625,743

[45] Date of Patent: Apr. 29, 1997

[54] DETERMINING A MASKING LEVEL FOR A SUBBAND IN A SUBBAND AUDIO ENCODER

[75] Inventor: James L. Fiocca, Palatine, Ill.

[73] Assignee: Motorola, Inc., Schaumburg, Ill.

[21] Appl. No.: 320,625

[22] Filed: Oct. 7, 1994

[51] Int. Cl.[6] ..... G10L 7/02

[52] U.S. Cl. ..... 395/2.14; 395/2.12; 395/2.21; 395/2.38; 395/2.3

[58] Field of Search ..... 395/2, 2.12, 2.13, 395/2.14, 2.2, 2.21, 2.3–2.33, 2.35–2.39, 2.67; 381/29–40

[56] References Cited

U.S. PATENT DOCUMENTS

| | | | |
|---|---|---|---|
| 5,109,417 | 4/1992 | Fielder et al. | 395/2.12 |
| 5,179,623 | 1/1993 | Dickopp et al. | 395/2 |
| 5,185,800 | 2/1993 | Mahieux | 395/2.38 |
| 5,222,189 | 6/1993 | Fielder | 395/2 |
| 5,285,498 | 2/1994 | Johnston | 395/2.12 |
| 5,357,594 | 10/1994 | Fielder | 395/2.2 |
| 5,394,473 | 2/1995 | Davidson | 395/2.67 |

OTHER PUBLICATIONS

Psychoacoustics, Facts and Models; E. Zwicker and H. Fastl; Springer–Verlag; 1990; chapter 4, pp. 56–103.

"Subband Coding of Digital Audio Signals"; R. N. J. Veldhuis, M. Breeuwer, and R. G. Van Der Waal; Phillips Journal of Research; vol. 44, nos. 2/3, 1989. pp. 329–342.

"Bit Rates in Audio Source Coding"; Raymond N. J. Veldhuis; IEEE Journal on Selected Areas inCommunications; vol. 10, No. 1, Jan. 1992, pp. 86–96.

"Coding of Moving Pictures and Associated Audio for Digital Storage Media at up to about 1.5 Mbits/s"; ISO/IEC 11172–3; annex D, pp. D–1—D–42, Aug. 20, 1991.

*Primary Examiner*—David D. Knepper
*Attorney, Agent, or Firm*—Darleen J. Stockley

[57] ABSTRACT

The first step for calculating a signal-to-mask ratio (806) for a subband in a subband in a subband audio encoder is calculating a signal level for each of the subbands based on an audio frame (604). Then, the masking level is calculated for the particular subband based on the signal levels, an offset function, and a weighting function (606).

18 Claims, 4 Drawing Sheets

DETERMINING A MASKING LEVEL FOR A SUBBAND IN A SUBBAND AUDIO ENCODER

FIELD OF THE INVENTION

The present invention relates generally to subband audio encoders in audio compression systems, and more particularly to low complexity masking level calculations for a subband in a subband audio encoder.

BACKGROUND OF THE INVENTION

Communication systems are known to include a plurality of communication devices and communication channels, which provide the communication medium for the communication devices. To increase the efficiency of the communication system, audio that needs to be communicated is digitally compressed. The digital compression reduces the number of bits needed to represent the audio while maintaining perceptual quality of the audio. The reduction in bits allows more efficient use of channel bandwidth and reduces storage requirements. To achieve audio compression, each communication device can include an encoder and a decoder. The encoder allows the communication device to compress audio before transmission over a communication channel. The decoder enables the communication device to receive compressed audio from a communication channel and render it audible. Communication devices that may use digital audio compression include high definition television transmitters and receivers, cable television transmitters and receivers, portable radios, and cellular telephones.

A subband encoder divides the frequency spectrum of the signal to be encoded into several distinct subbands. The magnitude of the signal in a particular subband may be used in compressing the signal. An exemplary prior art subband audio encoder is the International Standards Organization International Electrotechnical Committee (ISO/IEC) 11172-3 international standard, 20 Aug. 1991, hereinafter referred to as MPEG (Moving Picture Experts Group) audio. MPEG audio assigns bits to each subband based on the subband's mask-to-noise ratio (MNR). The MNR is the signal-to-noise ratio (SNR) minus the signal-to-mask ratio (SMR). The SMR is the signal level (SL) minus the masking level (ML). The SL, ML, SNR, SMR, and MNR are determined by a psychoacoustic unit. The psychoacoustic unit is typically the most complex element in an audio encoder, and the masking level calculation is typically the most complex element in a psychoacoustic unit. Also, the psychoacoustic unit is the most crucial element in determining the perceptual quality of an audio encoder, and the accuracy of the masking level calculation is crucial to the accuracy of the psychoacoustic unit.

Therefore, a need exists for a method, device, and systems that reduces the complexity of the masking level calculation while maintaining high perceptual quality in audio compression systems such as MPEG audio.

DETAILED DESCRIPTION OF A PREFERRED EMBODIMENT

The present invention provides a method, a device, and systems for determining a masking level for a frequency subband in a subband audio encoding system using less memory and requiring less complexity. The first step is determining a signal level for each of the subbands based on an audio frame. Then, the masking level is calculating for a subband based on the signal levels, an offset function, and a weighting function. With the present invention, the masking levels for the subbands in the subband audio encoder are efficiently calculated.

Figure 1:
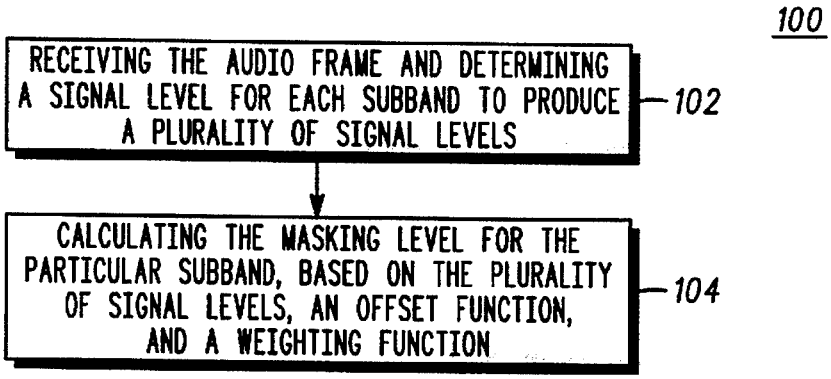
FIG. 1 is a flow diagram for implementing a method for determining a masking level for a subband in a subband audio encoder in accordance with the present invention.

The present invention is more fully described with reference to FIGS. 1–6. FIG. 1, numeral 100, is a flow diagram for implementing a method for determining a masking level for a subband in a subband audio encoder in accordance with the present invention. The method is generally implemented in a psychoacoustic unit. First, the audio frame (e.g., pulse code modulated (PCM) audio) is received and a signal level is determined for each subband, based on the audio frame (102). Then, the masking level is calculated for a particular subband, based on the signal levels, an offset function, and a weighting function (104).

Figure 2:
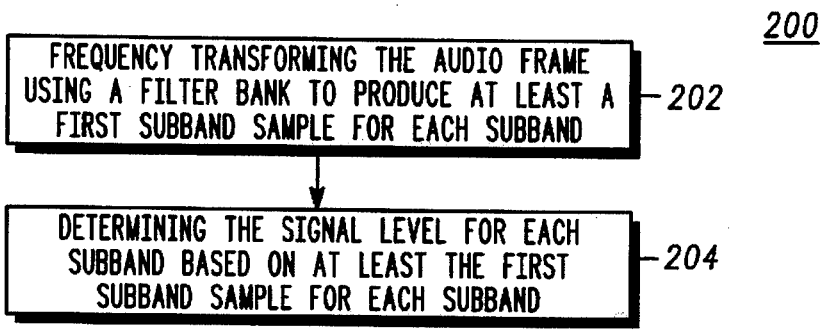
FIG. 2 is a flow diagram, shown with greater detail, of the step of determining a signal level for each subband using a filter bank in accordance with the present invention.

FIG. 2, numeral 200, is a flow diagram, shown with greater detail, of the step of determining a signal level for each subband using a filter bank in accordance with the present invention. The filter bank is used to filter the audio frame to produce one or more subband samples for each subband (202). The signal level is calculated (204) by summing the squares of each of the subband samples for the given subband, and then taking the logarithm (base 10) of the result. The resulting signal level is a very reliable measure of the relative energy (in decibels) of each subband in a given audio frame. The subband samples are the output of a filter bank. The number of samples per subband which the filter bank outputs is a function of the frame size of the audio encoder. This method of signal level calculation is very low complexity, as it does not involve an additional frequency transformer. The following equation summarizes the signal level calculation for each subband:

$$SL(sb) = 10 * \log_{10} \left\{ \sum_{s=0}^{nsamp-1} S(sb,s)^2 \right\}$$

where sb is a subband number, s is a subband sample number, S(sb,s) is the subband sample s of subband sb, and nsamp is the number of subband samples per subband.

Figure 3:
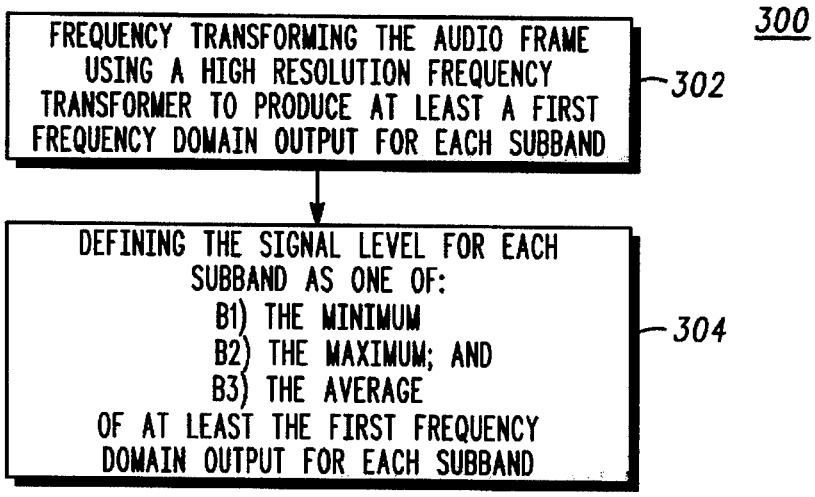
FIG. 3 is a flow diagram, shown with greater detail, of the step of determining a signal level for each subband using a high resolution frequency transformer in accordance with the present invention.

FIG. 3, numeral 300, is a flow diagram, shown with greater detail, of the step of determining a signal level for each subband using a frequency transformer in accordance with the present invention. Frequency transformation can be accomplished with a Discrete Fourier Transform (DFT). A DFT will produce one or more frequency domain outputs for each subband (302) using the following equation:

$$X(k) = 10 * \log_{10} \left\{ \left| \sum_{n=0}^{N-1} x(n)\, e^{\frac{-j2\pi nk}{N}} \right|^2 \right\} ; 0 \leqq k < \frac{N}{2}$$

where x(n) is a time domain input sample of the audio frame, X(k) the frequency domain output of the transform, and N the size of the transform. The number of frequency samples, N, can be larger than the number of subbands, sb. For example, if N=512 and sb=32, there would be 8 X(k)'s within each subband sb. The signal level for each subband could then be calculated as a minimum, a maximum, or an average (304) of the X(k)'s which fall within the subband as follows:

$$SL(sb) = min[X(k)];\ k \in sb \quad 1)$$

$$SL(sb) = max[X(k)];\ k \in sb \quad 2)$$

$$SL(sb) = 10 \times \log_{10} \sum_k 10^{\frac{X(k)}{10}} ;\ k \in sb \quad 3)$$

Figure 4:
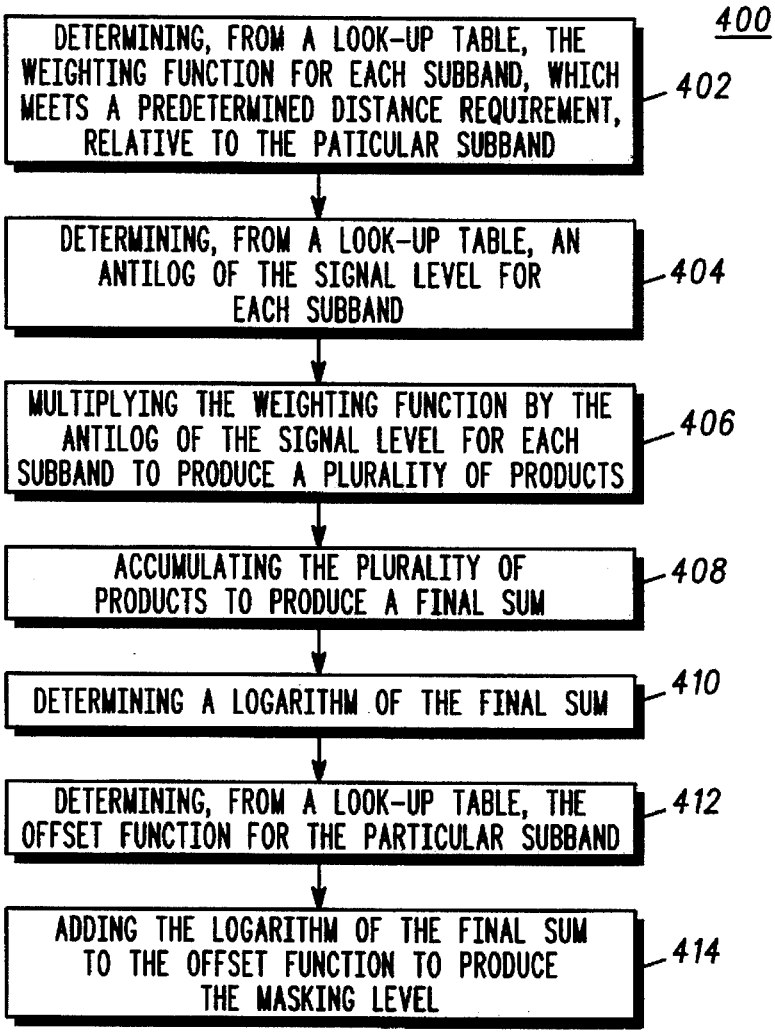
FIG. 4 is a flow diagram, shown with greater detail, of the step of calculating the masking level based on the plurality of signal levels, an offset function, and a weighting function in accordance with the present invention.

FIG. 4, numeral 400, is a flow diagram, shown with greater detail, of the step of calculating the masking level based on the plurality of signal levels, an offset function, and a weighting function in accordance with the present invention. First, the weighting function is determined, from a look-up table, for each subband, which meets a distance requirement, relative to the particular subband (402). The weighting functions and the distance requirement will be discussed below with reference to FIG. 5, numeral 500. Then, an antilog of the signal level is determined, from a look-up table, for each subband (404). The weighting function is multiplied by the antilog of the signal level for each subband to produce a plurality of products (406). Then, the products are accumulated to produce a final sum (408), and a logarithm of the final sum is determined (410). The offset function for the particular subband is determined, from a look-up table (412). The offset function is a function of a threshold in quiet for the subband and a bark value for the subband. Finally, the logarithm of the final sum is added to the offset function to produce the masking level (412).

The masking level calculation can be summarized by the following equation:

$$ML(sb) = 10 * \log_{10} \left\{ \sum_{k=k_init}^{k_init+num_k} wf(sb,k) * 10^{\frac{SL(k)}{10}} \right\} + of(sb)$$

where wf(sb,k) is the weighting function for subband k relative to the particular subband sb, of(sb) is the offset function for the particular subband sb, SL(k) is the signal level for subband k, k is an index representing a range of subbands which meet the distance requirement, k_init is the first subband which meets the distance requirement, and num_k is the number of subbands which meet the distance requirement. The offset function is determined with the following equations:

$$of(sb)=0.5*LTq(sb)-0.225*z(sb)+40;sb>0$$

$$of(sb)=0.5*LTq(sb)-0.225*z(sb);sb=0$$

where LTq(sb) is the threshold in quiet of subband sb, and z(sb) is the bark value of subband sb. The constant 40 is not added to the subband zero (the subband to which the human ear is most sensitive) offset function to further stress the importance of subband zero to the human ear.

Figure 5:
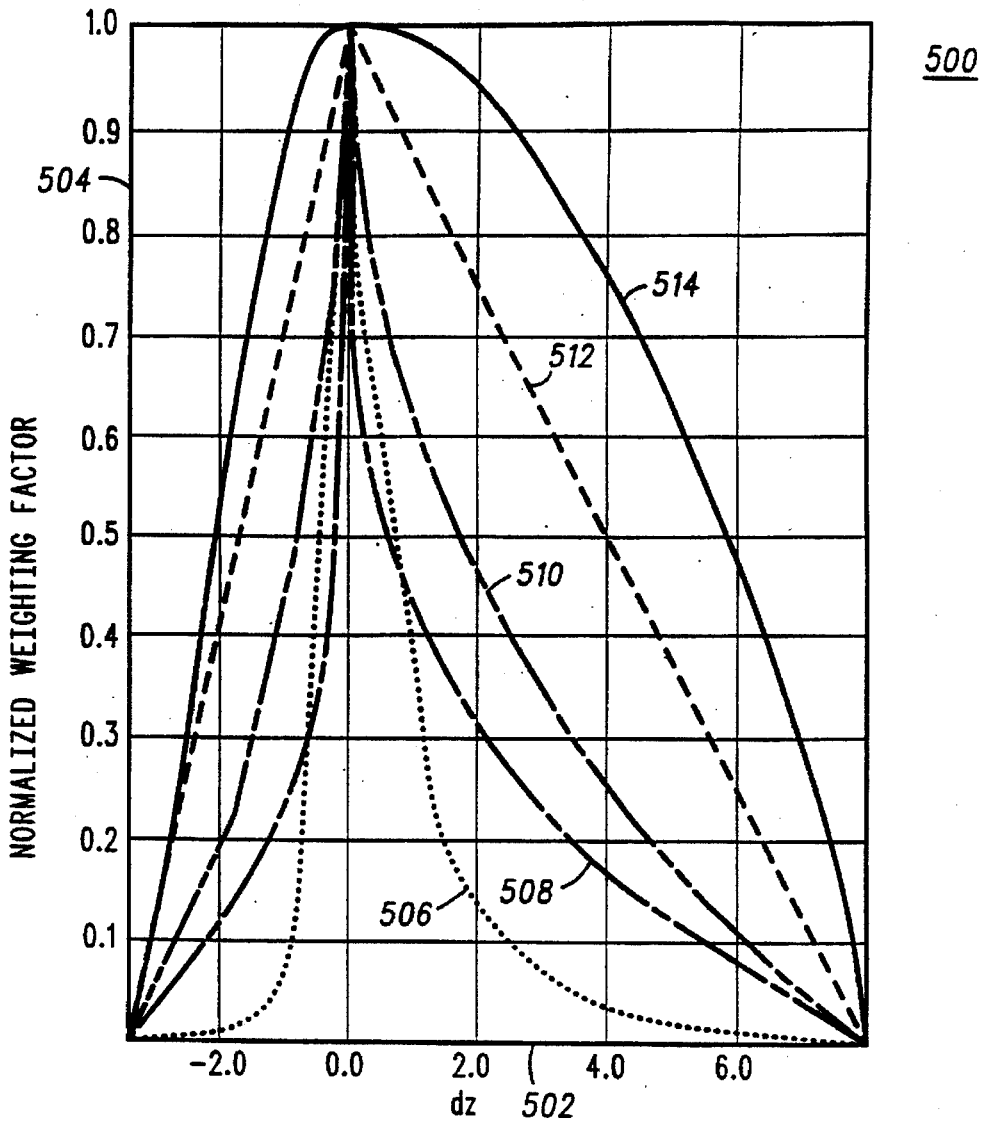
FIG. 5 is a graphic illustration of several exemplary masking curves in accordance with the present invention.

FIG. 5, numeral 500, is a graphic illustration of several exemplary masking curves in accordance with the present invention. The masking curve is required to determine the weighting function wf(sb,k). The masking curve estimates the extent to which signal energy at one frequency masks the perception of signal energy at another frequency to the human ear. The frequency scale is converted from absolute frequency to bark frequency because the bark scale represents linear frequency as perceived by the human ear (i.e., the human ear is more sensitive to subtle variations at lower frequencies than at higher ones). The greater the distance of the bark frequency of a subband to the bark frequency of the particular subband, the less it masks the particular subband. The independent axis (502), labeled "dz", is distance (in bark frequency) of the bark frequency of a subband to the bark frequency of the particular subband and is given by:

$$dz=z(sb)-z(k)$$

where z(k) is the bark scale frequency corresponding to a masking subband, and z(sb) is the bark scale frequency corresponding to the particular subband. The masking subbands can be limited to those which meet the distance requirement. If the distance requirement is not met, the subband does not significantly mask the particular subband. The particular subband is masked more by a lower frequency subband than by a higher frequency subband. Therefore, the masking effect is more pronounced for a positive dz. An example distance requirement is between −3 and 8 (in bark frequency) from the subband to the particular subband. The dependent axis (504), labeled "NORMALIZED WEIGHTING FACTOR", is the value of the weighting function normalized to a maximum magnitude of one (i.e., the masking curve).

The weighting function is the masking curve times a gain factor:

$$wf(dz)=a_g \times mc(dz)$$

where ag is the gain factor. A value of 0.001, which corresponds to −30 dB, is an example value of the gain factor. Examples of masking curves are as follows:

an exponential function (506) given by:

$$mc(dz) = e^{a_n \times dz} \qquad a_n = -\frac{1}{3}\ \ln(0.001) \qquad ; -3 \leqq dz \leqq 0$$

$$mc(dz) = e^{-a_p \times dz} \qquad a_p = -\frac{1}{8}\ \ln(0.001) \qquad ; 0 < dz < 8,$$

a cube root function (508) given by:

$$mc(dz) = \left(1 - a_n \times \sqrt[3]{dz}\right) \qquad a_n = -\frac{1}{\sqrt[3]{3}} \qquad ; -3 \leqq dz \leqq 0$$

-continued $$mc(dz) = \left(1 - a_p \times \sqrt[3]{dz}\right) \quad ; 0 < dz < 8,$$
$$a_p = \frac{1}{\sqrt[3]{8}}$$

a square root function (510) given by:

$$mc(dz) = (1 - a_n \times \sqrt{|dz|}) \quad ; -3 \leqq dz \leqq 0$$
$$a_n = \frac{1}{\sqrt{3}}$$

$$mc(dz) = (1 - a_p \times \sqrt{dz}) \quad ; 0 < dz < 8,$$
$$a_p = \frac{1}{\sqrt{8}}$$

a linear function (512) given by:

$$mc(dz) = (1 - a_n \times dz) \quad ; -3 \leqq dz \leqq 0$$
$$a_n = -\frac{1}{3}$$

$$mc(dz) = (1 - a_p \times dz) \quad ; 0 < dz < 8, \text{ and}$$
$$a_p = \frac{1}{8}$$

a square function (514) given by:

$$mc(dz) = (1 - a_n \times dz^2) \quad ; -3 \leqq dz \leqq 0$$
$$a_n = \frac{1}{9}$$

$$mc(dz) = (1 - a_p \times dz^2) \quad ; 0 < dz < 8$$
$$a_p = \frac{1}{64}$$

where $\alpha_p$ is a scale factor that achieves complete or nearly complete attenuation at a distance of 8, and $\alpha_n$ is a scale factor that achieves complete or nearly complete attenuation at a distance of −3. Of the five examples of weighting functions, the most favorable perceptual quality is produced with the exponential function (506).

Figure 6:
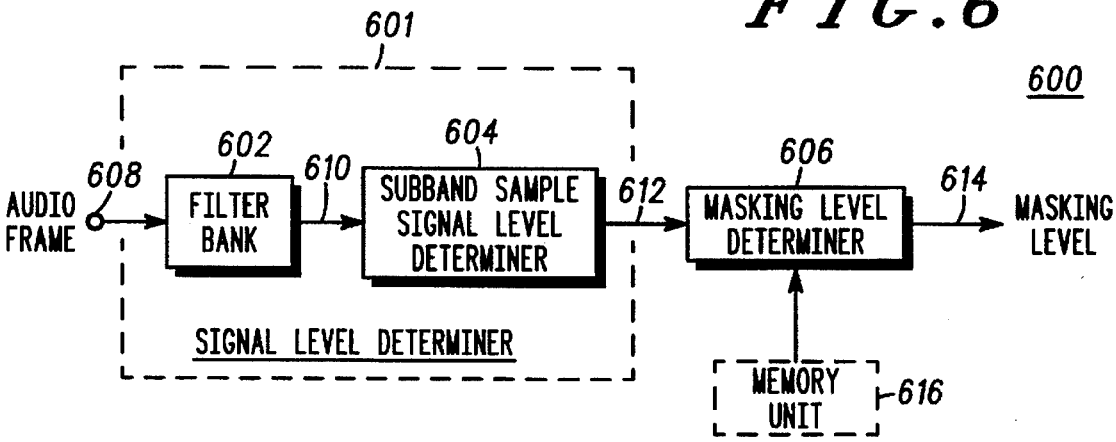
FIG. 6 is a block diagram of a device containing a filter bank implemented in accordance with the present invention.

FIG. 6, numeral 600, is a block diagram of a device containing a filter bank implemented in accordance with the present invention. The device contains a signal level determiner (601) and a masking level determiner (606). The signal level determiner further comprises a filter bank (602) and a subband sample signal level determiner (604).

The filter bank (602) filters the audio frame (e.g., pulse code modulated audio) (608) to produce one or more subband samples (610) for each subband. The subband sample signal level determiner (604) determines the signal level (612) for each subband based on one or more subband samples (610) for each subband. The masking level determiner (606) calculates the masking level (614) for a particular subband, based on the plurality of signal levels, an offset function, and a weighting function. The offset functions and the weighting functions for each subband can be stored in an optional memory unit (616).

Figure 7:
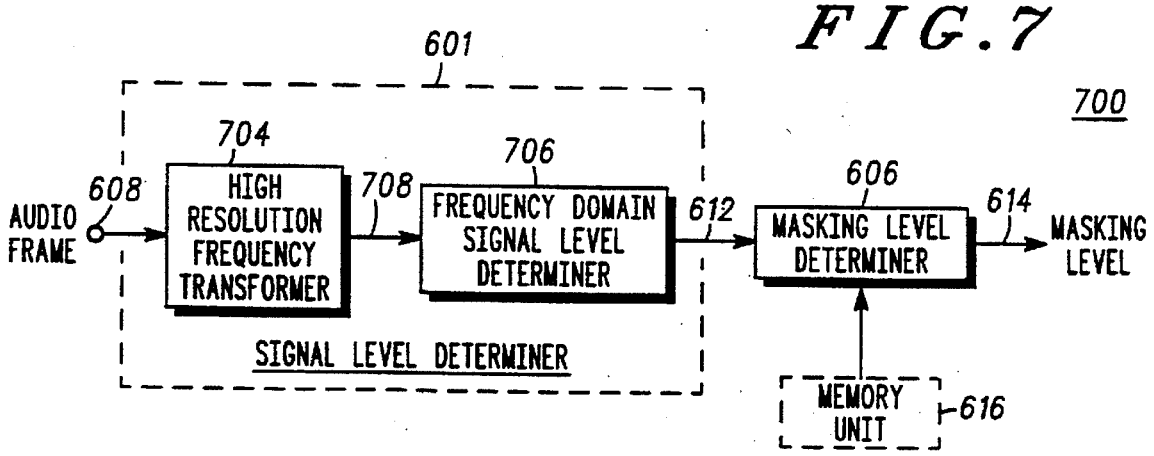
FIG. 7 is a block diagram of a device containing a high resolution frequency transformer implemented in accordance with the present invention.

FIG. 7, numeral 700, is a block diagram of a device containing a frequency transformer implemented in accordance with the present invention. As in FIG. 6, numeral 600, the device contains a signal level determiner (601) and a masking level determiner (606). For this embodiment, the signal level determiner further comprises a frequency transformer (704) and a frequency domain level determiner (706).

The frequency transformer (704) transforms (e.g., by using a Discrete Fourier Transform) the audio frame (e.g., pulse code modulated audio) (608) to produce one or more frequency domain outputs (708) for each subband. The frequency domain signal level determiner (706) determines the signal level (612) for each subband based on one or more subband samples (610) for each subband. The masking level determiner (606) calculates the masking level (614) for a particular subband, based on the plurality of signal levels, an offset function, and a weighting function. The offset functions and the weighting functions for each subband can be stored in an optional memory unit (616).

Figure 8:
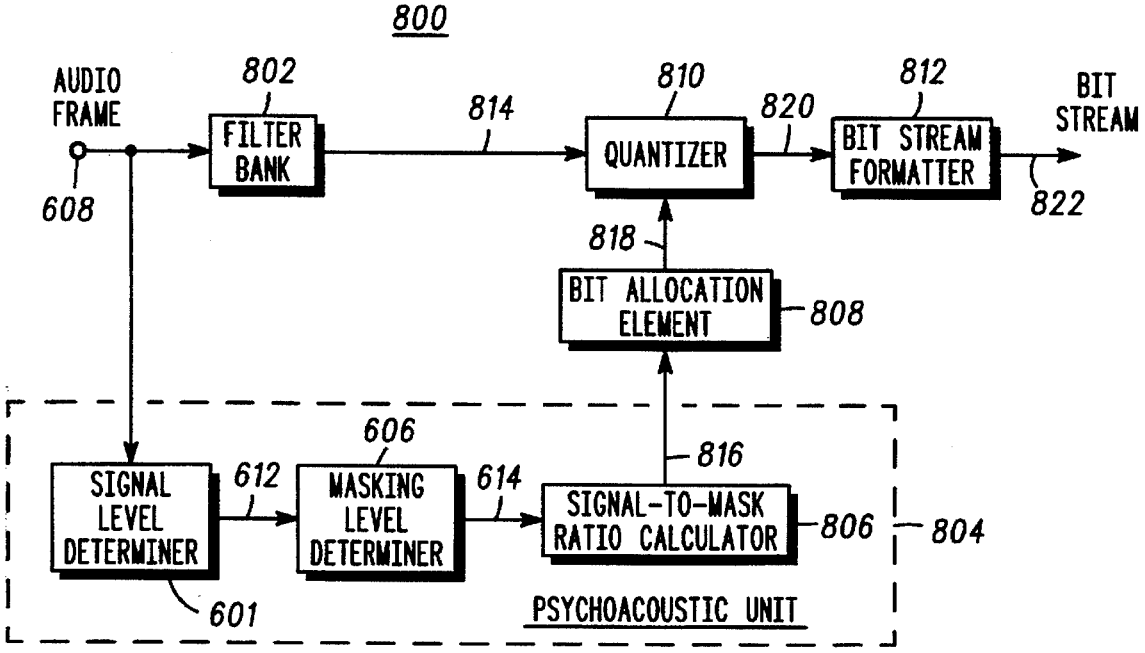
FIG. 8 is a block diagram of an embodiment of a system with a device implemented in accordance with the present invention.

FIG. 8, numeral 800, is a block diagram of an embodiment of a system with a device implemented in accordance with the present invention. The system includes a filter bank (802), a psychoacoustic unit (804), a bit allocation element (808), a quantizer (810), and a bit stream formatter (812). The psychoacoustic unit (804) further comprises a signal level determiner (601), a masking level determiner (606), and a signal-to-mask ratio calculator (806). A frame of audio (e.g., pulse code modulated (PCM) audio) (608) is analyzed by the filter bank (802) and the psychoacoustic unit (804). The filter bank (802) outputs a frequency domain representation of the frame of audio (814) for several frequency subbands. The psychoacoustic unit (804) analyzes the audio frame based upon a perception model of the human ear. The signal level determiner (601) determines the signal level (612) for each subband based on the audio frame (608). The masking level determiner (606) calculates the masking level (614) for a particular subband, based on the plurality of signal levels, an offset function, and a weighting function. The signal-to-mask ratio calculator (806) determines a signal-to-mask ratio (816) based on the signal levels (612) and masking levels (614). The bit allocation element (808) then determines the number of bits that should be allocated to each frequency subband based on the signal-to-mask ratio (816) from the psychoacoustic unit (804). The bit allocation (818) determined by the bit allocation element (808) is output to the quantizer (810). The quantizer (810) compresses the output of the filter bank (802) to correspond to the bit allocation (818). The bit stream formatter (812) takes the compressed audio (820) from the quantizer (810) and adds any header or additional information and formats it into a bit stream (822).

The filter bank (802), which may be implemented in accordance with MPEG audio by a digital signal processor such as the MOTOROLA DSP56002, transforms the input time domain audio samples into a frequency domain representation. The filter bank (802) uses a small number (e.g., 2–32) of linear frequency divisions of the original audio spectrum to represent the audio signal. The filter bank (802) outputs the same number of samples that were input and is therefore said to critically sample the signal. The filter bank (802) critically samples and outputs N subband samples for every N input time domain samples.

The psychoacoustic unit (804), which may be implemented in accordance with MPEG audio by a digital signal processor such as the MOTOROLA DSP56002, analyzes the signal level and masking level in each of the frequency subbands. It outputs a signal-to-mask ratio (SMR) value for each subband. The SMR value represents the relative sensitivity of the human ear to that subband for the given analysis period. The higher the SMR, the more sensitive the human ear is to noise in that subband, and consequently, more bits should be allocated to it. Compression is achieved by allocating fewer bits to the subbands with the lower SMR, to which the human ear is less sensitive. In contrast to the prior art that uses complicated high resolution Fourier transformations to compute the masking level, the present invention uses a simplified more efficient masking level calculation.

The bit allocation element (808), which may be implemented by a digital signal processor such as the MOTOROLA DSP56002, uses the SMR information from the psychoacoustic unit (804), the desired compression ratio, and other bit allocation parameters to generate a complete table of bit allocation per subband. The bit allocation element (808) iteratively allocates bits to produce a bit allocation table that assigns all the available bits to frequency subbands using the SMR information from the psychoacoustic unit (804).

The quantizer (810), which may be implemented in accordance with MPEG audio by a digital signal processor such as the MOTOROLA DSP56002, uses the bit allocation information (818) to scale and quantize the subband samples to the specified number of bits. Various types of scaling may be used prior to quantization to minimize the information lost by quantization. The final quantization is typically achieved by processing the scaled subband sample through a linear quantization equation, and then truncating the m minus n least significant bits from the result, where m is the initial number of bits, and n is the number of bits allocated for that subband.

The bit stream formatter (812), which may be implemented in accordance with MPEG audio by a digital signal processor such as the MOTOROLA DSP56002, takes the quantized subband samples from the quantizer (810) and packs them onto the bit stream (822) along with header information, bit allocation information (818), scale factor information, and any other side information the coder requires. The bit stream is output at a rate equal to the audio frame input bit rate divided by the compression ratio.

Figure 9:
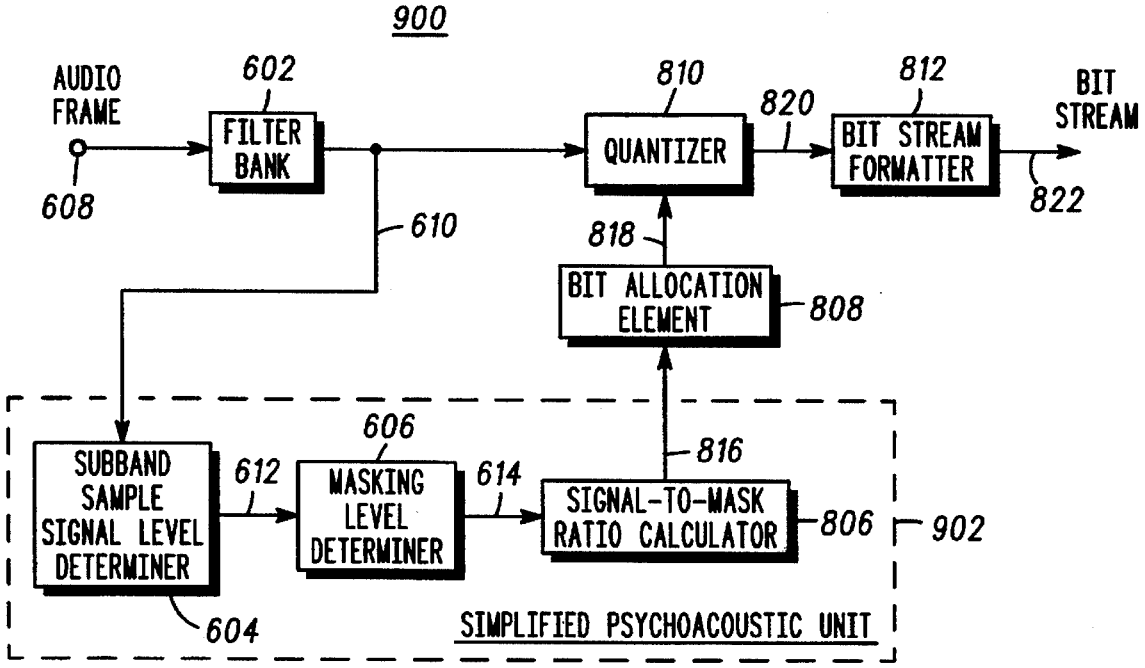
FIG. 9 is a block diagram of an alternate embodiment of a system with a device implemented in accordance with the present invention.

FIG. 9, numeral 900, is a block diagram of an alternate embodiment of a system with a device implemented in accordance with the present invention. The alternate system includes the filter bank (602), a simplified psychoacoustic unit (902), the bit allocation element (808), the quantizer (810), and the bit stream formatter (812). The simplified psychoacoustic unit is further comprised of the subband sample signal level determiner (604), the masking level determiner (606), and the signal-to-mask ratio calculator (806). A frame of audio (e.g., pulse code modulated (PCM) audio) (608), is analyzed by the filter bank (602). In contrast to the system in FIG. 8, numeral 800, the filter bank (602) outputs a frequency domain representation of the frame of audio (610) for several frequency subbands to both the simplified psychoacoustic unit (902) and the quantizer (810). The simplified psychoacoustic unit (902) analyzes the audio frame based upon a perception model of the human ear. The subband sample signal level determiner (604) determines the signal level (612) for each subband based on one or more subband samples (610) for each subband. The masking level determiner (606) calculates the masking level (614) for a particular subband, based on the plurality of signal levels, an offset function, and a weighting function. The signal-to-mask ratio calculator (806) determines a signal-to-mask ratio (816) based on the signal levels (612) and masking levels (614). The remaining system operation is as in the system in FIG. 8, numeral 800. The bit allocation element (808) then determines the number of bits that should be allocated to each frequency subband based on the signal-to-mask ratio (816) from the simplified psychoacoustic unit (902). The bit allocation (818) determined by the bit allocation element (808) is output to the quantizer (810). The quantizer (810) compresses the output of the filter bank (610) to correspond to the bit allocation (818). The bit stream formatter (812) takes the compressed audio (820) from the quantizer (810) and adds any header or additional information and formats it into a bit stream (822).

The present invention provides a method, a device, and systems for encoding a received signal in a communication system. With such a method, a device, and systems, both memory and computational complexity requirements are extremely reduced relative to prior art solutions. In a real-time software implementation on a digital signal processor such as the Motorola DSP56002, this means that encoder implementations become possible in a single low-cost DSP running at about 40 MHz. In addition, less than 32 Kwords of external memory are required. Some prior art solutions are known to require 3 such DSPs and significantly more memory. An alternate to the digital signal processor (DSP) solution is an application specific integrated circuit (ASIC) solution. An ASIC-based implementation of the present invention would have a greatly reduced gate count and clock speed compared to prior art.

While the present invention has been described with reference to illustrative embodiments thereof, it is not intended that the invention be limited to these specific embodiments. Those skilled in the art will recognize that variations and modifications can be made without departing from the spirit and scope of the invention as set forth in the appended claims.

We claim:

1. A method for determining a masking level for a particular subband in a subband audio encoder, wherein the subband audio encoder divides an audio frame into a plurality of subbands, the method comprising the steps of:

A) receiving the audio frame and determining, by a signal level determiner, a signal level for each subband to produce a plurality of signal levels; and B) calculating, by a masking level determiner, the masking level for the particular subband, based on the plurality of signal levels, an offset function, and a weighting function, wherein the offset function for each subband is a function of a threshold in quiet for the subband and a bark value for the subband, wherein the offset function is determined utilizing an equation of a form:

$$of(sb)=0.5*LTq(sb)-0.225*z(sb)+C$$

where C is a constant, LTq(sb) is the threshold in quiet of subband sb, and z(sb) is the bark value of subband sb.

2. The method of claim 1, wherein the audio frame is a pulse code modulated audio signal.

3. The method of claim 1, wherein step A) further comprises the steps of:

A) frequency transforming the audio frame using a filter bank to produce at least a first subband sample for each subband; and B) determining the signal level for each subband based on at least the first subband sample for each subband.

4. The method of claim 3, wherein step B) utilizes an equation of a form:

$$SL(sb) = 10 * \log_{10} \left\{ \sum_{s=0}^{nsamp-1} S(sb,s)^2 \right\}$$

where sb is a subband number, s is a subband sample number, S(sb,s) is the subband sample s of subband sb, and nsamp is a number of subband samples per subband.

5. The method of claim 1, wherein step A) further comprises the steps of:

A) frequency transforming the audio frame using a high resolution frequency transformer to produce at least a first frequency domain output for each subband;

B) defining the signal level for each subband as one of:

B1) the minimum;

B2) the maximum; and

B3) the average of at least the first frequency domain output for each subband.

6. The method of claim 5, wherein in the high resolution frequency transformer utilizes a Discrete Fourier Transform.

7. The method of claim 1, wherein step B) further comprises the steps of:

A) determining, from a look-up table, the weighting function for each subband, which satisfies a predetermined distance requirement, relative to the particular subband;

B) determining, from a look-up table, an antilog of the signal level for each subband;

C) multiplying the weighting function by the antilog of the signal level for each subband to produce a plurality of products;

D) accumulating the plurality of products to produce a final sum;

E) determining a logarithm of the final sum;

F) determining, from a look-up table, the offset function for the particular subband; and G) adding the logarithm of the final sum to the offset function to produce the masking level.

8. The method of claim 1, wherein the weighting function is a gain factor times a masking curve.

9. The method of claim 8, wherein the masking curve is non-linear with one of:

A) a convex geometry; and

B) a concave geometry.

10. The method of claim 9, wherein the masking curve is one of:

A) an exponential function;

B) a cube root function;

C) a square root function; and

D) a square function.

11. A device for determining a masking level for a particular subband in a subband audio encoder, wherein the subband audio encoder divides an audio frame into a plurality of subbands, the device comprising:

A) a signal level determiner for determining a signal level for each of the plurality of subbands, based on the audio frame, to produce a plurality of signal levels; and B) a masking level determiner, operably coupled to the signal level determiner, for calculating the masking level for the particular subband, based on the plurality of signal levels, an offset function, and a weighting function, wherein the offset function for each subband is a function of a threshold in quiet for the subband and a bark value for the subband, and wherein the offset function is determined utilizing an equation of a form:

$$of(sb)=0.5*LTq(sb)-0.225*z(sb)+C$$

where C is a constant, LTq(sb) is the threshold in quiet of subband sb, and z(sb) is the bark value of subband sb.

12. The device of claim 11, wherein the audio frame is a pulse code modulated signal.

13. The device of claim 11, wherein the signal level determiner further comprises:

A) a filter bank for frequency transforming the audio frame to produce at least a first subband sample for each subband; and B) a subband sample signal level determiner, operably coupled to the filter bank, for determining the signal level for each of the plurality of subbands based on at least the first subband sample for each subband.

14. The device of claim 11, wherein the signal level determiner further comprises:

A) a high resolution frequency transformer, for frequency transforming the audio frame to produce at least a first frequency domain output for each subband:

B) a frequency domain signal level determiner, operably coupled to the frequency transformer, for defining the signal level for each subband as one of:

B1) the minimum;

B2) the maximum; and

B3) the average of at least the first frequency domain output for each of the plurality of subbands.

15. The device of claim 14, wherein in the high resolution frequency transformer utilizes a Discrete Fourier Transform.

16. The device of claim 11, wherein the device further comprises a memory unit for storing the offset function and the weighting function for each of the plurality subbands.

17. A system having a device for determining a masking level for a subband in a subband audio encoder, wherein the subband audio encoder divides an audio frame into a plurality of subbands, the system comprises:

A) a filter bank for receiving and transforming the audio frame to produce frequency transformed audio;

B) a psychoacoustic unit for receiving the audio frame to produce a signal-to-mask ratio, wherein the psychoacoustic unit further comprises:

B1) a signal level determiner for determining a signal level for each subband, based on the audio frame, to produce a plurality of signal levels;

B2) a masking level determiner, operably coupled to the signal level determiner, for calculating the masking level for the subband, based on the plurality of signal levels, an offset function, and a weighting function; and B3) a signal-to-mask ratio calculator, for calculating a signal-to-mask ratio based on the masking level;

C) a bit allocation element, operably coupled to the psychoacoustic unit, for using the signal-to-mask ratio to generate bit allocation information;

D) a quantizer, operably coupled to the filter bank and the bit allocation element, for producing a compressed audio frame based on the frequency transformed audio and the bit allocation information;

E) a bit stream formatter, operably coupled to the quantizer, for using the compressed audio frame to generate a bit stream output, wherein the offset function for each subband is a function of a threshold in quiet for the subband and a bark value for the subband, and wherein the offset function is determined utilizing an equation of a form:

$$of(sb)=0.5*LTq(sb)-0.225*z(sb)+C$$

where C is a constant, LTq(sb) is the threshold in quiet of subband sb, and z(sb) is the bark value of subband sb.

18. A system having a device for determining a masking level for a subband in a subband audio encoder, wherein the subband audio encoder divides an audio frame into a plurality of subbands, the system comprises:

A) a filter bank for receiving and transforming the audio frame to produce frequency transformed audio;

B) a simplified psychoacoustic unit, operably coupled to the filter bank, wherein the simplified psychoacoustic unit further comprises:

B1) a subband sample signal level determiner, operably coupled to the filter bank, for determining a signal level for each subband, based on the frequency transformed audio, to produce a plurality of signal levels;

B2) a masking level determiner, operably coupled to the signal level determiner, for calculating the masking level for the subband, based on the plurality of signal levels, an offset function, and a weighting function; and B3) a signal-to-mask ratio calculator, for calculating a signal-to-mask ratio based on the masking level;

C) a bit allocation element, operably coupled to the psychoacoustic unit, for using the signal-to-mask ratio to generate bit allocation information;

D) a quantizer, operably coupled to the filter bank and the bit allocation element, for producing a compressed audio frame based on the frequency transformed audio and the bit allocation information;

E) a bit stream formatter, operably coupled to the quantizer, for using the compressed audio frame to generate a bit stream output, wherein the offset function for each subband is a function of a threshold in quiet for the subband and a bark value for the subband, and wherein the offset function is determined utilizing an equation of a form:

$$of(sb)=0.5*LTq(sb)-0.225*z(sb)+C$$

where C is a constant, LTq(sb) is the threshold in quiet of subband sb, and z(sb) is the bark value of subband sb.

* * * * *